US006648720B1

(12) United States Patent
Domingues

(10) Patent No.: US 6,648,720 B1
(45) Date of Patent: Nov. 18, 2003

(54) SELF PROPELLED WALKING TOY

(76) Inventor: Francisco Bicalho Domingues, Rua Umari, 65, Rio de Janeiro, R. J., 22221-150 (BR)

( * ) Notice: Subject to any disclaimer, the term of this patent is extended or adjusted under 35 U.S.C. 154(b) by 0 days.

(21) Appl. No.: 10/185,957

(22) Filed: Jun. 28, 2002

(51) Int. Cl.[7] ..... A63H 7/00
(52) U.S. Cl. ..... 446/356; 446/352; 446/353
(58) Field of Search ..... 446/36, 156, 158, 446/330, 352, 353, 355, 356, 358, 376, 377, 381, 487; 180/8.6

(56) References Cited

U.S. PATENT DOCUMENTS 3,559,336 A * 2/1971 Nozaki ..... 446/300
3,678,617 A * 7/1972 Nomura ..... 446/356
4,365,437 A * 12/1982 Jameson ..... 180/8.6
4,614,504 A * 9/1986 Yamasaki ..... 446/335
4,629,440 A * 12/1986 McKittrick et al. ..... 180/8.6
5,423,708 A 6/1995 Allen
5,674,105 A 10/1997 Hamlin
6,004,185 A 12/1999 Rehkemper
6,165,043 A 12/2000 Terzian et al.
6,257,950 B1 7/2001 Saleh

* cited by examiner

*Primary Examiner*—Derris H. Banks
*Assistant Examiner*—Bena B. Miller
(74) *Attorney, Agent, or Firm*—Richard L. Strauss, Esq.

(57) ABSTRACT

A self-propelled toy is disclosed that utilizes a combination of outboard "legs" and at least one inboard drive wheel in order to provide movement of the device over smooth and irregular terrain. The outboard legs are especially configured and adapted so as to cause of wobbling of the device during movement so as to enhance contact of the outboard legs with irregular terrain for improved mobility and to allow the device to engage and climb elevated surfaces.

14 Claims, 3 Drawing Sheets

SELF PROPELLED WALKING TOY

TECHNICAL FIELD

The present invention relates to the field of mechanical toys. More particularly, the present invention relates to self-propelled toys which provide amusement by moving along a surface by means of foot-like appendages.

BACKGROUND OF THE INVENTION

Spring powered toy cars utilizing wheels as a means of locomotion are well known. Also, it is well known to utilize mechanical legs to move toys along a surface. For example, U.S. Pat. No. 5,423,708 (the "'708 patent) discloses a robot toy which simulates the movement of a spider. The robot toy includes four pairs of operative cooperating legs located on either side of the main frame of the robot. The articulated robot legs disclosed in the '708 patent are configured so that alternate legs on each side of the toy—mirrored legs—are aligned in a down position so as to provide balance—and so reduce wobbling of the robot—when the toy is moving. While the '708 patent discloses a toy with mechanical legs on either side of a main frame, there is no means of locomotion provided and/or situated between the right and left robot legs. Also, the inherent "balancing" the device provided by the afore-mentioned alternate mirrored configuration of legs generally maintains the robot in an upright (balanced) position as the toy moves forward. Such a balancing effect prevents a change in attitude—from upright to canted to the left or right—which might otherwise allow the device to engage dips and depressions while traversing uneven terrain. Therefore, if the '708 robot should lose contact with trackable ground on either the right or left side of the device due to, for example, uneven terrain, locomotion is compromised. Furthermore, the outboard position of the legs extending from the '708 robot, are unable to engage terrain directly under the toy. Therefore, if the device attempts to traverse terrain demonstrating a peak or ridge oriented in line with the long axis of the toy—and direction of travel—, the outboard legs may become hopelessly suspended, "beached" upon the ridge directly under the frame of the toy and unable to make further progress. Also, although the articulated robot legs of the '708 device may provide suitable propulsion on various surfaces demonstrating adequate friction and/or demonstrating a texture allowing engagement of the robot legs, the small "footprint" provided by the disclosed legs may compromise movement on hard, smooth surfaces.

Conventional spring or electric motor driven toys utilizing outboard wheels in a similar manner as full size automobiles provide excellent movement and speed on hard, smooth surfaces. The term "outboard" as used throughout this specification and claims in regard to wheels, legs or other device parts refers to the lateral position of said parts in relation to the main frame of any such device. Therefore, outboard device legs and/or wheels would be generally located outside of the confines of extension of the frame or proximal to the lateral (right or left sides) of such devices. The term "inboard" as used throughout this specification and claims in regard to wheels, legs or other device parts, refers to the relative position of said parts as being within the confines and lateral extension of such device main frames. The "inboard" location of such propulsion means would include locating such means at or about the longitudinal axis (midline) of such devices as well as locations between said midline and the lateral extent of the device frame.

Wheeled toy vehicles may also be provided with textured—knobby—tires in order to increase traction when utilized on irregular surfaces. However, wheeled vehicle may not exhibit sufficient traction to negotiate highly irregular surfaces which may be negotiated by devices such as the '708 robot. Also, such wheeled toys, unless provided with sufficient ground clearance, may be likewise "beached" by an elevated ridge or other obstruction located directly under the toy and medial to such wheels.

It would be highly advantageous to provide a self-propelled toy which provided the advantages of both wheels and leg like locomotion means so as to maximize said toys ability to negotiate a wide variety of terrain. It would be further advantageous if said toy could exhibit both outboard and inboard means of locomotion in order to increase the likelihood of contact and traction of either means of locomotion with irregular and uneven terrain. It would be still further advantageous if said self-propelled toy were provided with a means to vary the attitude thereof, thereby alternating maximum contact of legs and or wheels located on opposite sides of said vehicle.

SUMMARY OF THE INVENTION

Now in accordance with the present invention a self-propelled toy is disclosed wherein locomotion is provided by both outboard legs as well as at least one inboard wheel. The self-propelled toy of the present invention is comprised of a frame having a front terminus, a back terminus, a right side, a left side, a top and a bottom. Paired, mirror image axil receiving holes aligned in both fore/aft as well as inferior/superior position are provided within and through the right and left sides of the frame. A plurality of leg members, rotatably mounted within said paired, mirror image receiving holes, extend laterally beyond the left and right sides of the frame, in an outboard configuration. Each such leg member includes a central axil segment, extending through and beyond the pair of mirror image receiving holes. Lateral to said axil segment, the leg member includes a bend of from about 80 to about 100 degrees, in regard to the longitudinal axis of the axil segment, so as to form two leg segments on either side of said axil segment. The leg segments are advantageously selected to be of a sufficient length so as to extend beyond the bottom of the frame during the below-described rotation of the leg member. The axil segment, medial to said bend is substantially straight as is the leg segment, distal to said bend. However, in certain preferred embodiments of the present invention, the leg member may additionally include, distal to the leg segment, a foot segment, just distal to a further 80 to 100 degree bend. The foot segment serves, as discussed in further detail below, to increase the surface area of contact—or "foot print"—of the leg member as said member, periodically, comes in to contact with terrain below the toy to provide traction and locomotion. The paired axil receiving holes through which the leg members are mounted, may be advantageously positioned and oriented in close approximation to the bottom of the frame so as to facilitate periodic contact of the leg or foot segments with terrain under the toy, as well as to provide superior ground clearance. A leg drive gear is mounted, medial to the right and left side of the frame, upon the axil segment. The drive gear is configured and adapted—is of a size and includes a tooth arrangement—so as to enable the leg drive gear to mesh and engage the below-described transfer gears so as to transfer torque and rotation to and between leg members for propulsion of the device.

At least one inboard main drive wheel is rotatably mounted within the confines of the left and right side of the frame, said wheel extending beyond the bottom portion of said frame. The main drive wheel, as discussed below, provides an additional means of propulsion (inboard wheel propulsion) through contact, rotation and traction against terrain under the toy. The main drive wheel is configured so as to include circumferentially located gear teeth so as to provide a means of transferring torsional force and rotation from a motor to the leg members (outboard foot propulsion) either by directly engaging a proximal leg drive gear or indirectly, via a transfer gear/unit, speed control gear or combinations thereof as discussed in greater detail, below. The gear teeth of the main drive wheel (or as it is also described herein "the main drive gear") also act as a means of increasing traction of the wheel against terrain. A motor unit, utilizing a drive means, such as, for example, a coil spring motor, battery powered electric motor or solar powered electric motor, provides torsional power to the toy. For example, a spring drive unit and main drive wheel may be advantageously mounted upon a main drive axil. The main drive axil is advantageously and rotatably mounted through a pair of mirror image axil receiving holes. Embodiments of the present invention utilizing spring drive motors may advantageously include wind handles located at distal termini of the main drive for providing power (winding of) to the spring motor. Upon winding of the spring motor, stored torsional power is applied by the spring motor in order to rotate the main drive axil, which, in turn, rotates the drive wheel.

As described above, the drive wheel is advantageously configured to extend beyond the inferior (bottom portion) extent of the frame so as to enable engagement of terrain under the toy. The drive wheel is also advantageously provided with gear "teeth" as are all of the gears utilized herein. The teeth of the drive wheel enhance the ability of the wheel to be utilized as a means of propelling the toy. In addition, the drive wheel is, in certain preferred embodiments of the present invention, especially configured and adapted (includes gear count and size) to mate with and rotate a transfer gear mounted upon a transfer axil proximate to the main drive axil. The transfer axil, similarly mounted within a pair of mirror image axil receiving holes, positions the transfer gear so as to engage both the main drive wheel (and mate with the teeth thereupon) as well as to mate and engage with a leg drive gear. The present invention contemplates the use of at least two leg members. However, regardless of the number of leg members utilized, the present invention contemplates the use of a transfer unit—a transfer gear mounted upon a transfer axil—in order to transmit torsional force between/among said leg members. Thus, the main drive wheel, upon engaging and rotating a transfer gear, enables rotation of all leg members included therein via the transfer gear unit(s) coupling all such leg drive gears.

Alternatively, a speed control unit, comprised of a speed control axil, mounted within a pair of mirror image axil receiving holes, and a speed control gear mounted thereupon, may, in certain preferred embodiments, be interposed between the main drive wheel and the proximate transfer unit or leg drive gear. The speed control unit serves to control the rotational speed of the leg members. In such embodiments, the speed control unit is positioned so that the speed control gear mates, meshes and engages with the main drive wheel. Rotational speed transferred to the leg members via the transfer units may—in such embodiments—may be increased, or decreased, by interposing a speed control gear between the drive wheel and the transfer gear—in embodiments interposing a transfer gear between the main drive gear and proximal leg drive gear—and by selecting gear ratios, counts and sizing so as to attain such desired speed control. The use of gear configuration to control speed is well known to the art.

In addition to speed control units, other regulatory means, such as, for example, regulatory balance units utilizing weights may be utilized in order to regulate and control toy performance. The use of balance weights and other such devices to control spring powered devices is also well known to the art.

As discussed above, each leg member includes a straight axil segment extending through and beyond said paired mirror image receiving holes and beyond the lateral extension of the frame. After extending beyond the right and left sides of the frame and mounting holes therein, the leg members are bent at an approximately 80–100 degree angle. Thereafter, the leg members may advantageously include a further 80–100 degree bend so as to define a "foot like" foot segment in order to obtain broader contact with a surface to be traversed. The leg members are advantageously configured so that the leg segments at terminal ends of each such member are in diametric –180 degree—circumferential diametric relation so that, for example, when the leg segment at one terminus of a leg member is perpendicular to the longitudinal axis of the frame and directed downward, against the terrain below, the leg segment at the opposite terminus is also perpendicular to the longitudinal axis of the frame, but oriented upward and over the toy. Such orientation is advantageous in causing the toy to wobble, to a certain extent during locomotion. Such wobbling allows the device to engage depressions in terrain otherwise beyond the "reach" of the leg members when the device is perfectly balanced. It is preferred that the plurality of leg members are mounted and aligned within the frame so that none of the leg segments on either side of the frame are in circumferential alignment. A "staggering" arrangement which provides, for example, for a 90 degree rotational disparity between sequential leg segments on either side of the toy may be advantageously selected so as to increase the afore-mentioned shifting in device attitude (tilting to the left and right relative to the direction of travel during toy movement).

Each of the leg members includes a drive gear mounted upon the axil segment. Transfer gears, mounted upon transfer gear axils, are provided to engage said drive gears and thereby transfer rotational power between said leg members, while also maintaining the afore-mentioned circumferential relationships between said leg members and the foot like portions extending therefrom. The transfer gear axils are also rotatably mounted within paired, mirror image axil receiving holes in the right and left sides of the frame.

In a preferred embodiment of the present invention, the foot-like segment of the leg members may be coated and/or covered with a resilient material such as, for example, a rubber or plastic material, so as to provide still further traction.

As discussed above, at least one inboard drive wheel, rotatably mounted within the right and left confines the frame, extends below the frame so as to enable engagement of terrain below the device as an additional means of locomotion. Said drive wheel also includes a plurality of gear teeth of such a number and configuration as to enable engagement of the above described transfer gear or, in alternate embodiments, a speed control gear. Wind handles, located a distal termini of, for example, a spring motor, may be utilized to energize the spring motor as well as a further means of locomotion. For example, after winding the toy, the device may be placed on a surface. Thereafter, as the spring motor transfers rotational force back to the main drive axil, the wind handles located on distal ends thereof, also rotates and thus may provide an additional means of propulsion.

By utilizing the aforementioned combination of at least one inboard drive wheel and a plurality of leg means aligned so as to cause "wobbling" of the device, the self-propelled toy of the present invention in able to continue movement across uneven terrain. In instances wherein the device is positioned upon a high ridge, with depressed areas to either side of the toy, the at least one inboard drive wheel provides continued locomotion. In those instances wherein the terrain is so irregular as to obviate the use of a drive wheel, the foot-like projections of the leg means provide continued locomotion. In those instances where the terrain to either side of the toy is uneven, the wobbling effect thereof allows the device to tilt so as to enable contact of the foot-like projection with terrain for continued progress.

DETAILED DESCRIPTION

Figure 1:
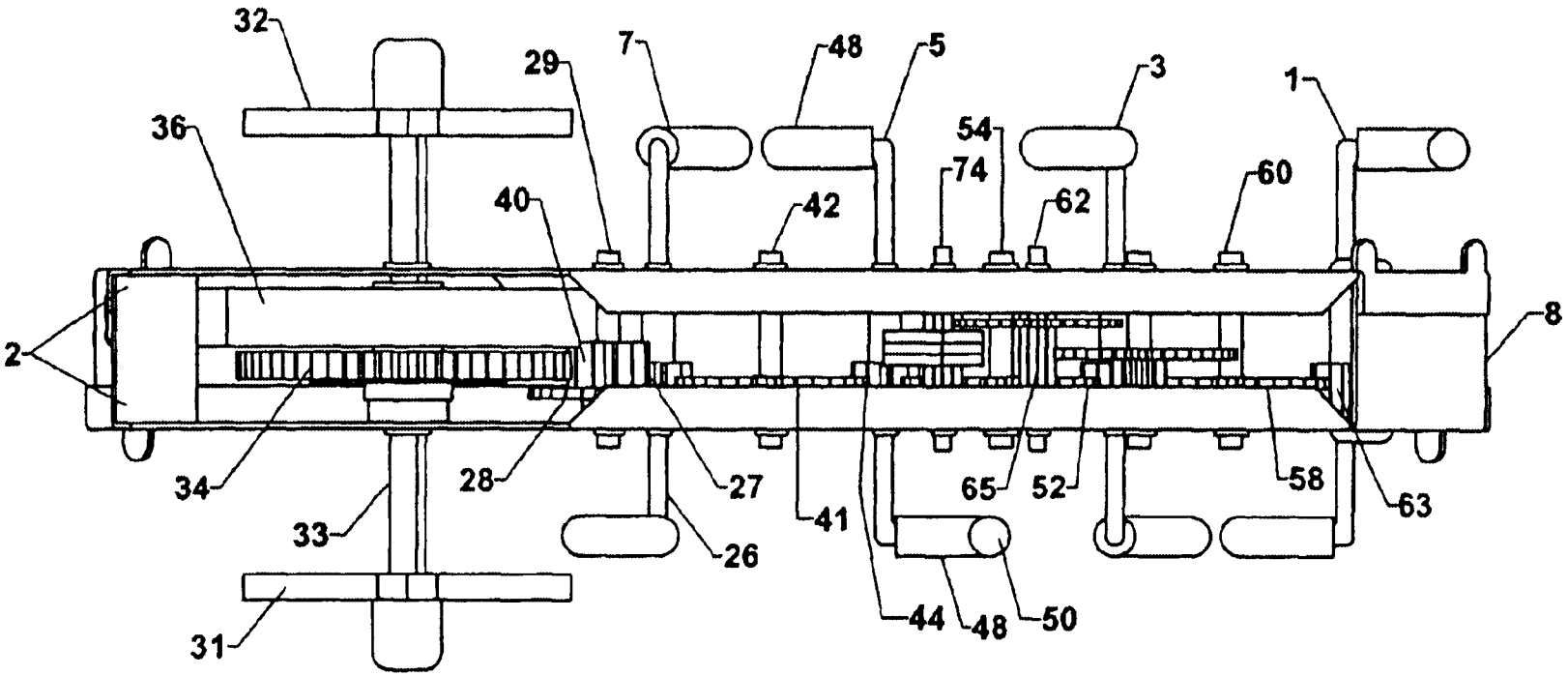
FIG. 1 is a top view of a preferred embodiment of the present invention having four leg members and one inboard drive wheel. according to a preferred embodiment of the present invention.
Figure 2:
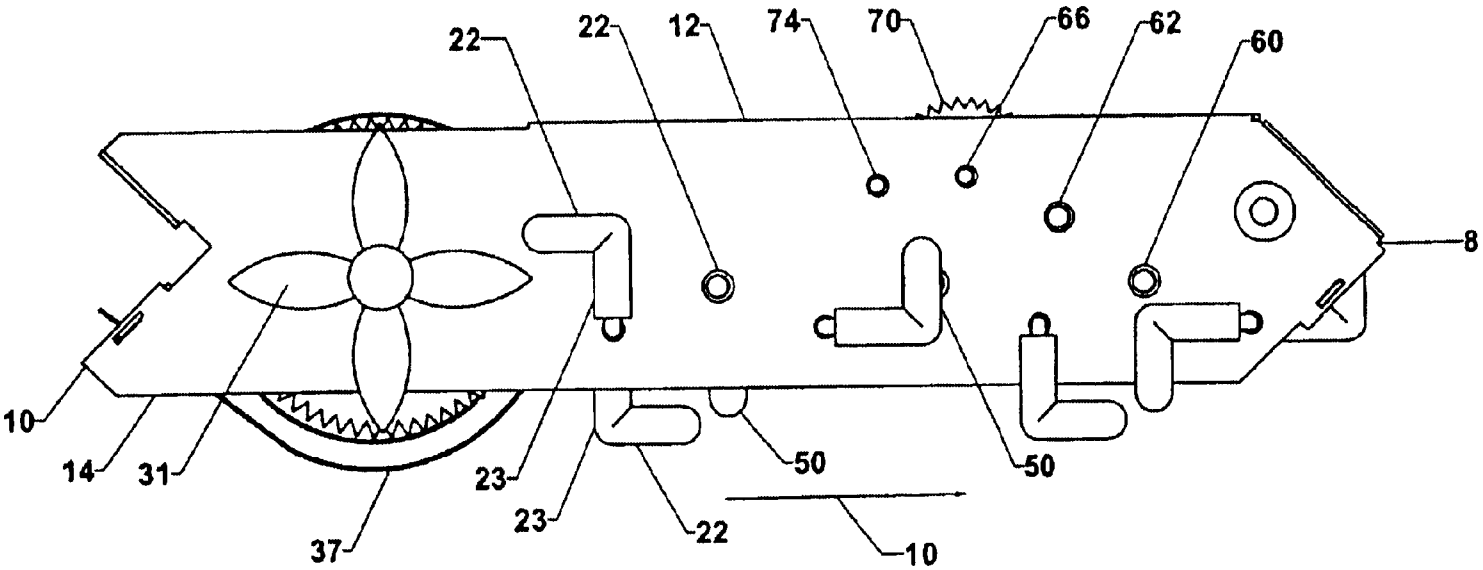
FIG. 2 is a side view of the preferred embodiment of FIG. 1 on uneven terrain.
Figure 3:
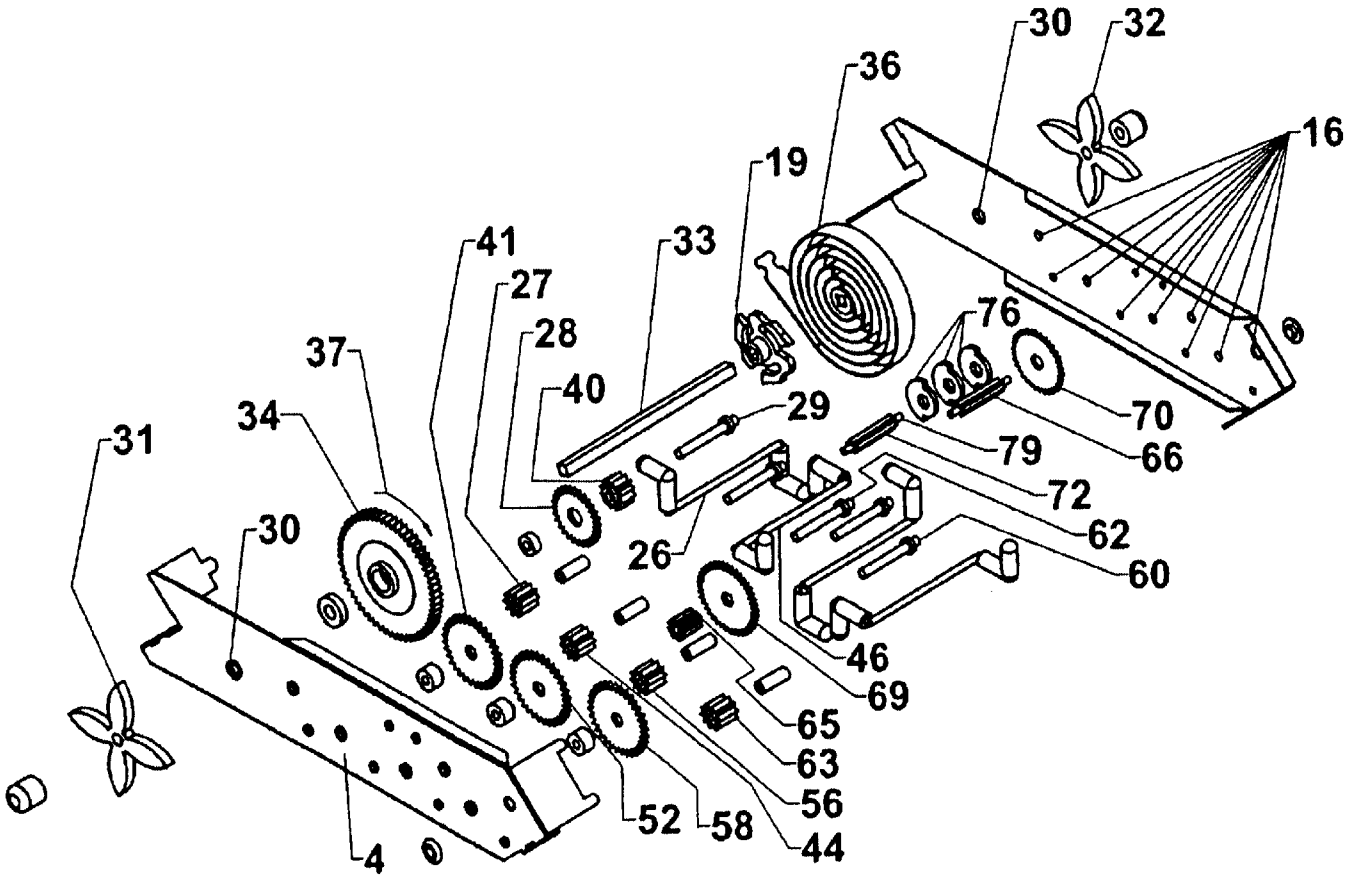
FIG. 3 is front right side exploded view of the preferred embodiment of FIG. 1.

FIGS. 1, 2 and 3 illustrate a preferred embodiment of the present invention utilizing a coil spring motor 36 as motor means. The self-propelled toy is comprised of a frame 2 having a right side 4, a left side 6, a front terminus 8, a rear terminus 10, a top 12 and a bottom 14. The right 4 and left 6 sides of the frame 2 include paired, mirror image axil receiving holes 16 for the rotatable mounting of the afore and below-mentioned axils. In the preferred embodiment illustrated in FIG. 1, four leg members 1, 3, 5 and 7 are rotatably mounted in paired, mirror image axil receiving holes located within the right and left sides of the frame.

A motor drive unit comprised of a coil spring 36 and drive wheel 34 are mounted upon main drive axil 33 which includes wind handles 31 and 32 affixed to the termini thereof. The main drive axil 33 is rotatably mounted within paired mirror image axil receiving holes 30 and 30'. The main drive axil 33 is fitted with ratchet sprocket 19 so as to allow said coil spring to be wound sequentially without immediately unwinding upon release of the wind handles. Drive wheel 34 is especially configured and adapted to include gear teeth that mesh with speed control gear 40 located upon speed control axil 29. However, as discussed above, in certain alternate preferred embodiments of the present invention, the main drive wheel may engage an intermediate transfer gear without utilizing a speed control unit. The drive wheel is also configured and adapted to extend below the bottom of frame 2 so as to enable use of said wheel as a means of locomotion. For example, as coil spring 36 is wound via manual rotation of wind handles 31 or 32, the coils of said motor are tightened so as to store potential torsional energy. Upon release of the wind handles—after sufficient winding—, said motor applies torsion to main drive axil 33 so as to cause said axil to rotate in the direction indicated by arrow 37. As the main drive axil rotates, drive wheel 34 also rotates. Since the drive wheel is configured to extend below the bottom 14 of the frame, the rotation of said wheel propels the toy forward in the direction of arrow 10 when said wheel contacts a surface below the frame. Since the drive wheel is also configured and adapted to mesh with speed control gear 40, the motor driven rotation of drive wheel 34 also caused the speed control gear, as well as the speed control axil upon which it is mounted, to rotate. The speed of rotation of the speed control axil 29, relative to the speed of the drive wheel, and thus the speed of rotation of the below described leg means, may be controlled by varying the size, and tooth configuration of the speed control gear and the drive wheel. A transfer gear 28 is also mounted upon the speed control axil. The transfer gear is especially configured and adapted to engage and mesh with leg drive gear 27 located upon an axil segment 26 of leg member 7. The axil segment of leg member 7 extends beyond paired mirror image axil receiving holes so as to extend, laterally from the sides of the frame. Thereafter, the leg member includes a bend of approximately 80 to 100 degrees so as to form leg segments 23 and 23'. The leg segments of the present invention are advantageously configured so as to extend below the bottom of the frame so that foot segments 22 and 22' may periodically contact terrain below the toy during locomotion. In addition, leg segments 23 and 23' are in a diametric relation so that when leg segment 23 and foot segment 22 are positioned so as to extend straight down, below the toy,—in a 6 o'clock or 180 degree position, leg segment 23' and foot segment 22' are oriented straight up—in a 12 o'clock or 0 degree position.

As the leg drive gear 27 is rotated by the action of transfer gear 28, the axil segment 25 of leg member 26 also rotates thereby causing the rotation of leg segments 23 and 23' and foot segments 22 and 22' so as to cause said leg segments to periodically engage terrain lateral and below the toy and cause movement in the direction of arrow 10. Since leg segments 23 and 23' are in a diametric relationship—said leg segments being oriented so as to extend in opposite directions, each of the respective foot segments 22 and 22' contact terrain at points of rotation 180 degrees apart so as to cause a wobbling of the toy. In fact, each of the leg members and respective leg and foot segments utilized in the present invention demonstrate such diametric orientation and positioning so that the toy cants, to the right and left of a centered, balanced position during operation. Such canting provided several advantages such as, for example, the ability of the self-propelled toy to traverse terrain that is irregular. For example, in instances where a depression in terrain located just lateral to the toy's frame and beneath a foot segment would otherwise be beyond reach of the foot segment—if the toy were to remain perfectly upright—the toy is able to cant in the direction of the trough through the action of a leg segment contacting the terrain on an opposite side of the toy. The canting or, as it may also be described, wobbling of the device enables the toy to engage terrain otherwise unavailable for contact, traction and propulsion. Conversely, the toy vehicle is likewise able to traverse irregular terrain including mounds or other elevated areas lateral to the toys frame due to the same wobbling effect. Furthermore, in instances where the vehicle approaches a raised edge otherwise to high to engage and traverse, the aforementioned wobbling effect enables a forward leg member of the toy to engage and climb such edges.

Rotation of leg gear 27, in turn, caused rotation of transfer gear 41 which is mounted upon transfer axil 42 which is circumferentially mounted within paired mirror image axil receiving holes with the right and left sides of the frame. The transfer gear 41 is especially configured and adapted so as to engage and mesh with the teeth of leg gear 44 located upon axil segment 46 of leg member 5. Rotation of leg gear 44 causes leg member 5 as well as leg segments 48 and 48' to rotate so as to enable periodic contact of foot segments 50 and 50' with terrain under the toy for propulsion. Since leg segments 48 and 48' are in 180 degree diametric position, foot segments 50 and 50' provide the same wobbling effect and advantages as described above in regard to leg member 7. In fact, each of the leg members of the preferred embodiment described in FIG. 1 demonstrate a like diametric leg/foot arrangement so as to enable said effects and advantages.

Leg gear 44 is also similarly configured and arranged so as to engage and provide for the rotation of transfer gear 52 located upon transfer axil 54 also mounted in paired, mirror image axil receiving holes within the frame. In a similar manner, rotation of transfer gear 52 caused rotation of leg gear 56 as well as leg member 3 upon which said gear is mounted so as to provide rotation and propulsion of the device in the same manner as rotation of leg member 7 and 5. Rotation of leg gear 56 also causes rotation of transfer gear 58 positioned upon transfer axil 60 which, in turn engages leg gear 63 which, in turn provides rotation of leg member 1 upon which it is positioned. Thus, the present invention utilizes transfer gears to transfer rotational force and motion to a plurality of outboard leg members which, in turn, provide propulsion of the toy.

The present invention may also, advantageously include a balance device wherein a weight is utilized to control the speed and extend the movement of the toy. For example, in the embodiment described in FIGS. 1, 2 and 3, transfer gear 58, in addition to transferring rotational power and movement between leg means 1 and 3, also engages and meshes with axil gear 65 located upon transfer axil 62 so as to provide a rotation of said gear. Transfer gear 64, also mounted upon transfer axil 62 is especially configured and adapted to engage and mesh with of axil gear 66 located upon balance axil 68—which said axil also includes transfer gear 70. Thus, rotation of transfer gear 58 also causes the rotation of transfer axil 62, transfer axil 68 and transfer gear 70 located thereupon. Transfer gear 70 is especially configured, positioned and adapted to engage and mesh with balance axil gear 72 which is mounted upon balance axil 74. The afore-mentioned balance axil also includes balance weights 76 mounted thereupon. As the balance axil is rotated by the operation of the aforementioned transfer gears and axils, the balance weights store centrifugal force. The torsional force required to rotate the balance weight acts as a speed regulator so as to control the rotational speed of the aforementioned gears, axils and leg members. In addition, the balance weights store centrifugal energy so as to extend the operation and movement of the toy.

The above-described main drive wheel provides the self-propelled toy of the present invention with an inboard means of propulsion. Such inboard propulsion is available whenever the terrain under the toy, and the degree of extension of the wheel below the frame, allows contact between wheel and the surface thereunder. The outboard leg and foot segments provide propulsion whenever the terrain lateral to the frame and under the legs allows contact. However, the aforementioned wobbling effect of the toy, enabled by diametric positioning of the leg segments, further improves contact of leg and foot segments with terrain by allowing the device to lean to the right and left of its upright direction of travel so as to "reach" for traction. In embodiments of the present invention incorporating the aforementioned wind handled, said handles may act as still another means of outboard propulsion. Thus, the self-propelled toy of the present invention provides a device demonstrating superior qualities to traverse irregular surfaces. The present invention also utilized, in certain preferred embodiments, an electric motor powered by dry cell batteries, solar power, or a combination thereof in order to provide rotational force and movement.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the following claims.

I claim:

1. A self-propelled toy comprised of:

a frame having a right side, a left side, front terminus, rear terminus, top and bottom and wherein said left and right side of said frame includes a plurality of paired, mirror image axle receiving holes, each pair of mirror image axle receiving holes being aligned in relation to the front and rear terminus as well as the top and bottom of said frame;

at least two leg members rotatably mounted within a pair of said paired mirror image axle receiving holes, each said leg member including, in a medial portion thereof, an axle segment including a leg drive gear mounted thereupon, two leg segments located lateral to said axle segment oriented and configured so that a longitudinal axis of said leg segments is in an angular relationship of from about 80 to about 100 degrees with a longitudinal axis of said axle segment and wherein the leg segments are in a diametric relation, one to the other and in an outboard relation to the frame;

at least one transfer gear unit comprised of a transfer gear axle, rotatably mounted within mirror image axle mounting holes of said frame and a transfer gear mounted upon said axle, said transfer gear being especially configured and adapted so as to mate with and engage said leg drive gear;

a drive motor unit comprised of a main drive axle rotatably mounted within and extending through a pair of said mirror image axle receiving holes, a drive motor and an inboard drive wheel mounted upon said main drive axle, said inboard drive wheel being especially configured and adapted to transfer rotational force to said leg members as well as to to extend beyond the bottom of said frame as an inboard means of propulsion;

wherein, when the drive motor is powered and said toy is placed upon a surface, torsional force provided by said motor rotates said main drive axle and drive wheel mounted thereupon so that said wheel propels said toy along said surface when the wheel is in contact therewith, and wherein said main drive wheel also provides rotational force to and thereby rotates said outboard leg members so as to propel said toy along said surface when the leg segments thereof are in contact with said surface.

2. The self propelled toy of claim 1 wherein said leg member additionally comprises a foot segment located distal to each of said leg segments and in an angular relationship of from about 80 to 100 degrees therewith.

3. The self propelled toy of claim 2 wherein said foot segment is coated with a elastic coating.

4. The self-propelled toy of claim 1 wherein said drive motor is a spring motor.

5. The self-propelled toy of claim 1 wherein said at least one transfer gear unit transfers torsional force between said main drive wheel and a proximal leg drive gear.

6. The self-propelled toy of claim 1 additionally including a speed control unit.

7. The self-propelled toy of claim 6 wherein said speed control unit comprises a speed control axle, rotatably mounted upon and within a pair of said mirror image axle receiving holes, a speed control gear mounted upon said control axle, said speed control gear being especially configured and adapted so as to engage and mate with the main drive gear and wherein said speed control unit also includes a transfer gear configured and adapted so as to mate and engage at least one leg drive gear.

8. The self propelled toy of claim 1 additionally comprising a regulatory balance unit.

9. The self propelled toy of claim 4 wherein said main drive axle includes wind handles located and positioned at distal termini of said axle.

10. The self propelled toy of claim 9 where said wind handle is especially configured and adapted to engage terrain under said toy for propulsion thereof.

11. The self-propelled toy of claim 1 wherein said drive motor is an electric motor.

12. The self-propelled toy of claim 11 wherein said electric motor is battery powered.

13. The self-propelled toy of clam 12 wherein said electric motor is solar powered.

14. The self-propelled toy of claim 13 wherein said electric motor is powered by both solar power and batteries.

* * * * *